US007117548B1

(12) United States Patent
Reyes

(10) Patent No.: US 7,117,548 B1
(45) Date of Patent: Oct. 10, 2006

(54) TOILET VENTILATION SYSTEM

(76) Inventor: Horacio Reyes, 1408 Drayton Ct., Orlando, FL (US) 32825

( * ) Notice: Subject to any disclaimer, the term of this patent is extended or adjusted under 35 U.S.C. 154(b) by 5 days.

(21) Appl. No.: 11/067,801

(22) Filed: Feb. 28, 2005

(51) Int. Cl.
*E03D 9/04* (2006.01)

(52) U.S. Cl. ..... 4/213; 4/216; 4/217; 4/352

(58) Field of Classification Search ..... 4/213, 4/216, 217, 347–352
See application file for complete search history.

(56) References Cited

U.S. PATENT DOCUMENTS 3,059,245 A * 10/1962 Bell ..... 4/213
3,120,006 A * 2/1964 Knappe ..... 4/213
3,277,499 A * 10/1966 Keefauver ..... 4/213
3,287,743 A * 11/1966 Coates ..... 4/213
4,745,639 A 5/1988 Wileman, III
4,924,532 A 5/1990 Pennestri
4,980,931 A 1/1991 Meisels
5,193,227 A * 3/1993 Crowley, Jr. ..... 4/213
5,704,074 A * 1/1998 Baldea ..... 4/213
5,781,937 A * 7/1998 Liang ..... 4/213
6,055,677 A * 5/2000 McKinley ..... 4/217
6,567,994 B1 * 5/2003 Spurr et al. ..... 4/217

* cited by examiner

*Primary Examiner*—Charles E. Phillips

(57) ABSTRACT

A toilet ventilation system comprising a seat mounted atop a typical toilet bowl and pivoting about a seat swivel mount, the seat with vacuum intake holes disposed on the lower side, the intake holes communicating with a vacuum canal within the seat; the vacuum canal terminating in a flexible vacuum outlet of the seat, the vacuum outlet communicating with a vacuum hose connected to a conical vacuum pump with integral electric motor, a check valve atop the pump, the pump installed in the toilet base cavity, the check valve connecting to exhaust exiting via sewer pipe below the toilet.

18 Claims, 5 Drawing Sheets

TOILET VENTILATION SYSTEM

BACKGROUND OF THE INVENTION

Bathroom, and specifically toilet ventilation has been pursued over the years with a variety of designs and techniques, with typically similar approaches. Ventilation of a bathroom space is most efficiently affected by venting at the source of the odors. Therefore, ceiling vents and ceiling fans are inherently flawed. Not only must an immediate toilet area itself be ventilated, it must be done so forcefully, with powered forced air. Additionally, venting the toilet itself is most efficiently done by venting the exact area of odor, namely the seat area. Typical problems have involved the design of the seat itself and more specifically the ventilation holes and their size, orientation and placement. Other problems have been faced in the forced ventilation device, its design, location, switching, and noise level. Further problematic areas have been the pathway of vented gasses and the gas's final environment.

What is needed is a ventilated seat that is properly designed for the most efficient forced air ventilation of odors, switching that activates the ventilation only when needed, and venting the gasses to the most effective environment for removal. And, gasses should not have an opportunity to return to the toilet environment. Additionally, a proper toilet ventilation system should be as unobtrusive as is possible. Most important, the toilet ventilation system should be applicable to existing toilets with the least possible number of changes and parts additions to the toilets. The present invention solves these problems and concerns.

FIELD OF THE INVENTION

The invention relates to toilet ventilation and more specifically to a toilet ventilation system.

SUMMARY OF THE INVENTION

The general purpose of the toilet ventilation system, described subsequently in greater detail, is to provide a toilet ventilation system which has many novel features that result in an improved toilet ventilation system which is not anticipated, rendered obvious, suggested, or even implied by prior art, either alone or in combination thereof.

To accomplish this, the invention comprises a toilet seat of typical oval shape. Connect tubes horizontally radiate through the seat, preferably in a front area of seat. The inner area of the seat comprises inner ventilation holes. Inner ventilation holes open to the inner diameter of the seat. Inner ventilation holes communicate with the connect tubes. Connect tubes further communicate with outer ventilation holes. Outer ventilation holes open to the exterior edge of seat. Air outside of the perimeter of seat is thereby communicated to an area within the inner perimeter of seat. This feature of supplying outside air for ventilation is especially important for when the mass of a user effectively blocks other outside sources of ventilation air. Vacuum intake holes communicate downwardly with a lower surface of the seat. Vacuum holes are in the rear half of the seat. Other examples of the invention position vacuum holes throughout the seat. A vacuum canal comprises a substantial inner area within the seat. The vacuum intake holes communicate with the vacuum canal. A flexible vacuum outlet departs vacuum canal at a rear of the seat and bends at a smooth angle to exit the side rear of the seat proximal to one seat swivel mount. A vacuum hose joins the flexible vacuum outlet. Gasses evacuated through vacuum holes, through the vacuum canal, and out of flexible vacuum outlet exit via the vacuum hose to travel to the conical vacuum pump.

The conical vacuum pump is shaped and sized to fit within the toilet bowl cavity of virtually any typical toilet. The vacuum motor and check valve are integrally contained within the conical vacuum pump, motor and check valve assembly.

The shape and size of the integral construction of these components provides for installation within a toilet bowl cavity. Bowl cavities are extremely limited in space and in shape. Vacuum pump location provided by the unique conical pump and integral motor and check valve provides for not only installing the pump out of sight but also for significantly muffling if not totally quieting the operation of the pump and motor, an important attribute of the invention. The conical vacuum pump motor is powered by standard electrical outlet voltage. One example of the invention transforms standard outlet voltage to operate the 12 volt motor. Other examples of the invention offer motors to operate on various voltage outputs.

The front of the seat is spaced slightly above the toilet bowl top. The on/off switch is disposed in the bottom of the front of the seat. The rear of the seat is also held above the rear of the toilet bowl top. A typical seat swivel mount is used to mount the seat to the bowl. Examples of the invention provide tabs on the bottom of the seat for supporting the seat at a height slightly above the toilet bowl top.

A floor below the typical toilet houses a typical toilet flange. A spacer/seal surrounds and seals a toilet to a flange. The sewer hose of the invention enters the floor near to and outside of the flange. The sewer hose empties into the sewer pipe, as does the toilet. Gasses are thereby vented to the same outlet plumbing as the toilet wastes, therefore venting to the proper environment, as they should. Gasses are transmitted from the seat to the vacuum hose.

A small semi-circular area at the bottom base of the toilet bowl is formed with any appropriate tool. The vacuum hose thereby gains entry into the toilet bowl cavity in the bottom of the toilet. The pump is placed into the toilet bowl cavity. The vacuum hose enters the pump intake. Gasses pass through the pump to the check valve accompanying the vacuum pump. The check valve further prevents backflow of gasses to the toilet seat or area. The pump exhausts gasses through the sewer hose and to the sewer pipe that leaves a toilet area. Two distinct advantages are provided by the arrangement of exiting gasses. First, the toilet itself is trapped such that sewer gasses cannot come back through a toilet bowl. Second, the check valve of the pump prevents gasses from returning to the toilet area via the invention. It is therefore of singular importance that the gasses evacuated from the seat and seat area exit a bathroom space only via the sewer pipe. Not only is this pathway closer and more direct than a typical ceiling fan exhaust, it is also much more efficient. Odors do not emanate from the toilet itself, thereby negating the need to evacuate an entire toilet space. Further, utilizing the invention is much more cost effective than having to evacuate an entire toilet space.

The invention is installed either prior to a typical toilet installation or after. Installation after a toilet has been fitted to a toilet flange requires only making a hole in the floor and the sewer pipe, lifting of the toilet, installing the conical pump and hose, inserting the sewer from the pump into the floor hole and sewer pipe hole, and refitting the toilet to the floor.

Thus has been broadly outlined the more important features of the toilet ventilation system so that the detailed description thereof that follows may be better understood and in order that the present contribution to the art may be better appreciated.

Numerous objects, features and advantages of the toilet ventilation system will be readily apparent to those of ordinary skill in the art upon reading the following detailed description of presently preferred, but nonetheless illustrative, embodiments of the toilet ventilation system when taken in conjunction with the accompanying drawings. In this respect, before explaining the current embodiments of the toilet ventilation system in detail, it is to be understood that the invention is not limited in its application to the details of construction and arrangements of the components set forth in the following description or illustration. The invention is capable of other embodiments and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the toilet ventilation system. It is therefore important that the claims be regarded as including such equivalent constructions insofar as they do not depart from the spirit and scope of the present invention.

Objects of the toilet ventilation system, along with various novel features that characterize the invention are particularly pointed out in the claims forming a part of this disclosure. For better understanding of the toilet ventilation system, its operating advantages and specific objects attained by its uses, refer to the accompanying drawings and description.

BRIEF DESCRIPTION OF THE PREFERRED EMBODIMENT

DETAILED DESCRIPTION OF THE DRAWINGS

With reference now to the drawings, and in particular FIGS. 1 through 6 thereof, the example of the toilet ventilation system employing the principles and concepts of the present invention and generally designated by the reference number 10 will be described.

Figure 1:
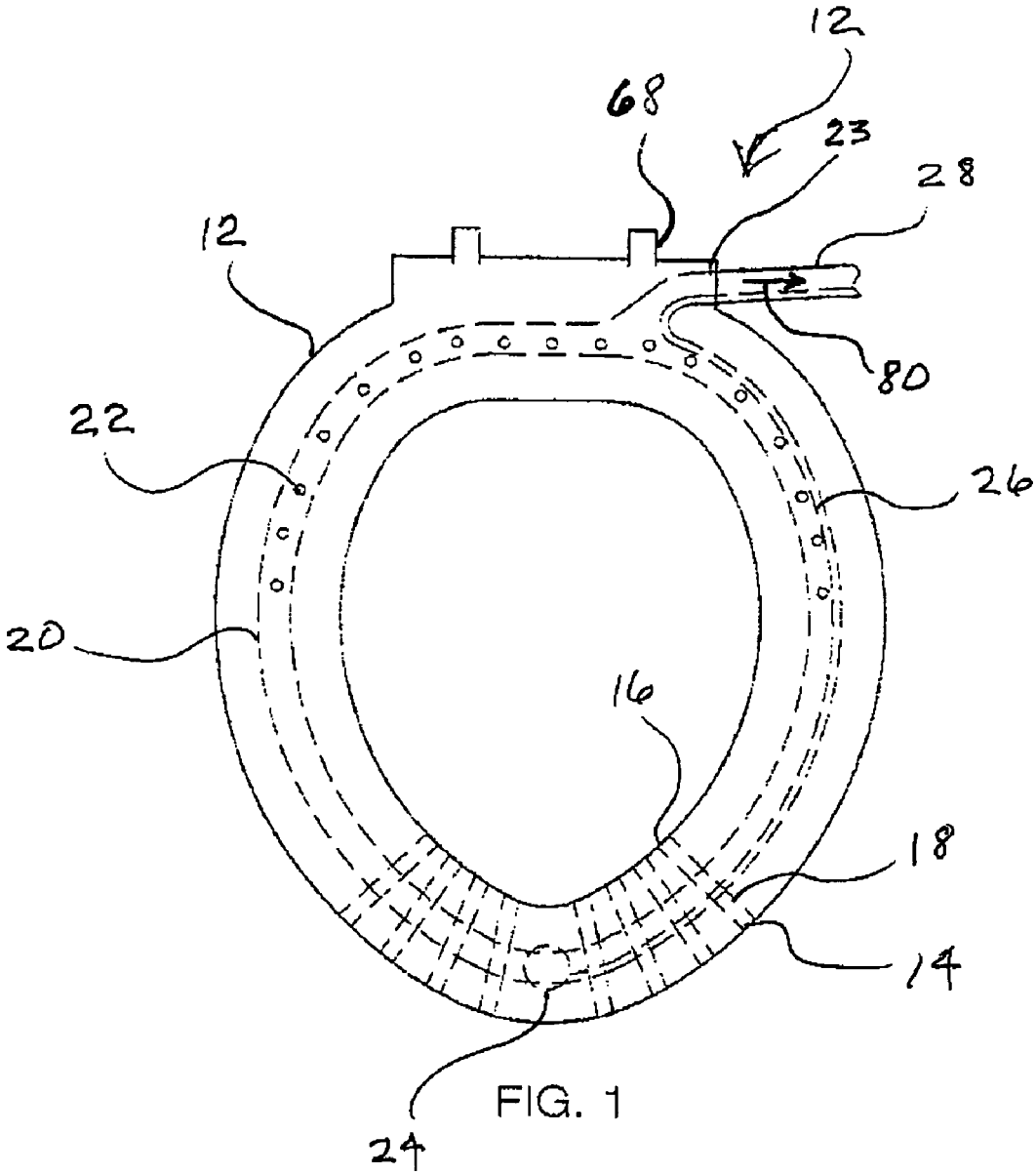
FIG. 1 is a top plan view of the toilet seat of the invention.
Figure 2:
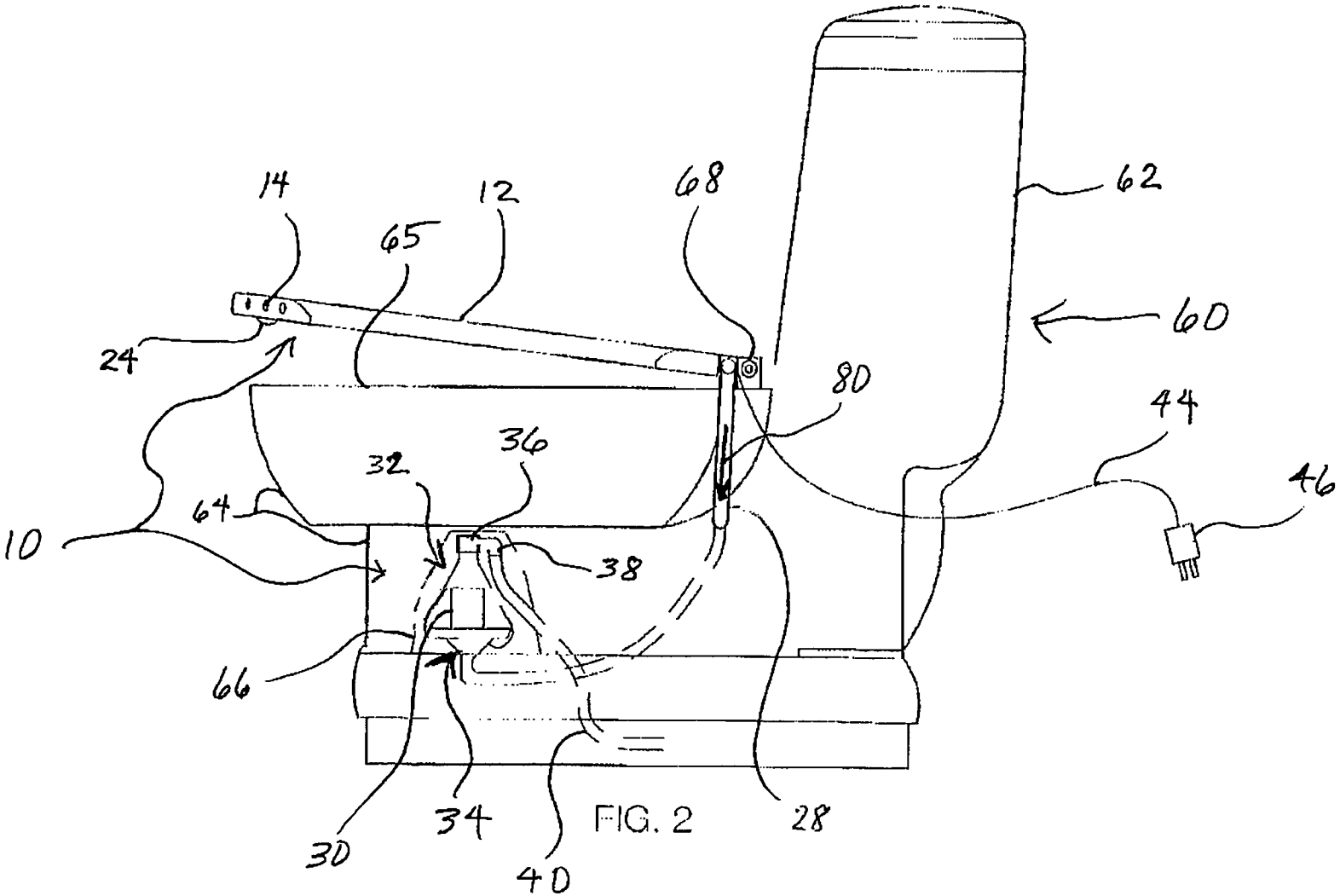
FIG. 2 is a side elevation view of the invention installed on a typical toilet.

Referring to FIG. 1, the seat 12 of the invention 10 comprises a typical oval shape. Connect tubes 18 horizontally radiate through a front area of seat 12. The inner area of the front of the seat 12 comprises inner ventilation holes 16. Inner ventilation holes 16 open to the inner diameter of seat 12. Inner ventilation holes 16 communicate with connect tubes 18. Connect tubes 18 further communicate with outer ventilation holes 14. Outer ventilation holes 14 are open to the exterior front edge of seat 12. Air outside of the perimeter of seat 12 is thereby communicated to an area within the inner perimeter of seat 12. Vacuum intake holes 22 are disposed within a back half of seat 12 and communicate downwardly with a lower surface of seat 12. Vacuum canal 20 comprises a substantial inner area of seat 12 oval shape. Vacuum intake holes 22 communicate with vacuum canal 20. Flexible vacuum outlet 23 departs vacuum canal 20 at a rear of seat 12 and bends at a smooth angle to exit the side rear of the seat 12 proximal to one seat swivel mount 68. Vacuum hose 28 also houses switch wire 26. Wire 26 departs on/off switch 24 to pass within canal 20. On/off switch 24 is disposed within the front bottom surface of seat 12. Vacuum hose 28 joins flexible vacuum outlet 23. Power cord 44 departs vacuum hose 28 proximal to flexible vacuum outlet 23 (FIG. 2). Directional flow 80 is the pathway of gasses evacuated through vacuum holes 22, through vacuum canal 20, and out of flexible vacuum outlet 23 and vacuum hose 28.

Referring to FIG. 2, the invention 10 is installed on a typical toilet 60. Toilet 60 is comprised of typical toilet reservoir 62 rearward and atop of typical toilet bowl 64. Seat 12 of invention 10 is mounted atop toilet bowl top 65. Seat 12 mounts via a pair of seat swivel mounts 68. The front of seat 12 is spaced slightly above toilet bowl top 65. On/off switch 24 is disposed below the bottom of the front of seat 12. Spacers (not shown) space seat 12 slightly above toilet bowl top 65. Outer ventilation holes 14 emanate from the front edge of seat 12. Vacuum hose 28 flexibly extends downward to attach to the bottom of conical vacuum pump 32 at pump intake 34. Power cord 44 exits vacuum hose 28 proximal to flexible vacuum outlet 23. The conical vacuum pump 32 resides within the typical bowl cavity 66. The vacuum motor 30 drives the conical vacuum pump 32. Vacuum motor 30 is an integral part within conical vacuum pump 32. Check valve 36 is integrally fixed within the top of the conical vacuum pump 32. The exhaust 38 of the check valve is immediately proximal to the check valve 36. The exhaust 38 is a downward right angle design. The downwardly disposed right angle exit of the exhaust 38 provides for the sewer hose 40 to fit proximally to the upward portion of the conical vacuum pump 32 and flow smoothly therefrom.

Figure 3:
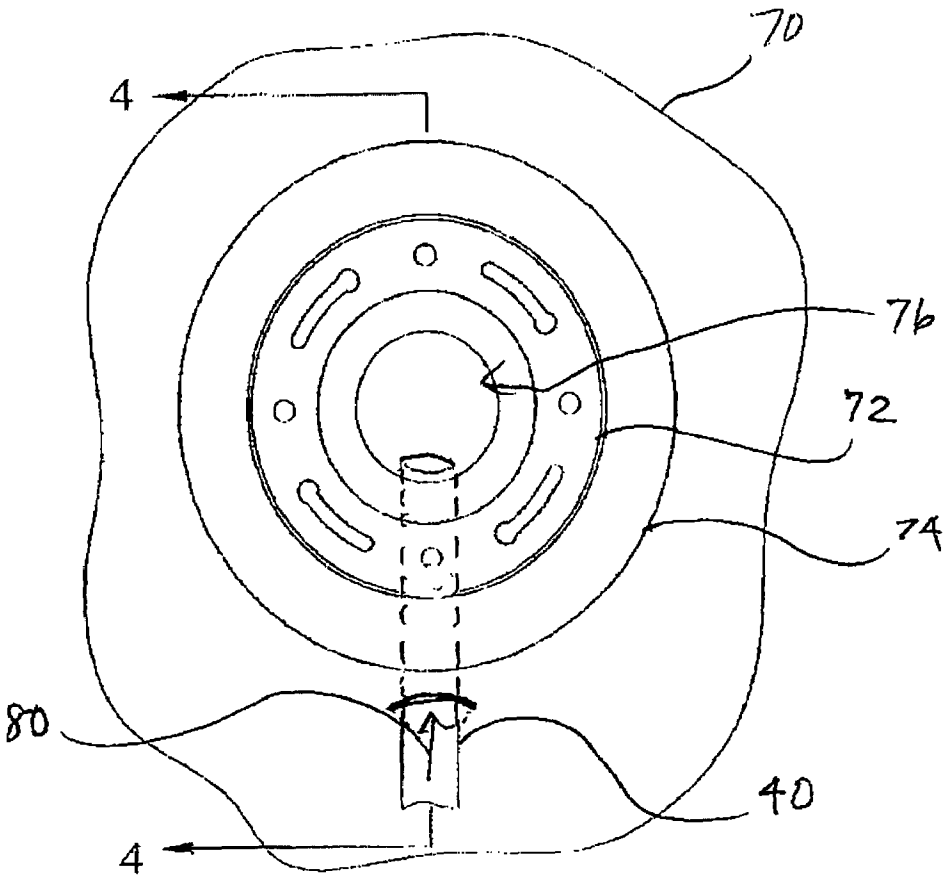
FIG. 3 is a top plan view of a typical toilet flange with the invention sewer hose entering the floor and exiting into the sewer pipe below the flange.
Figure 4:
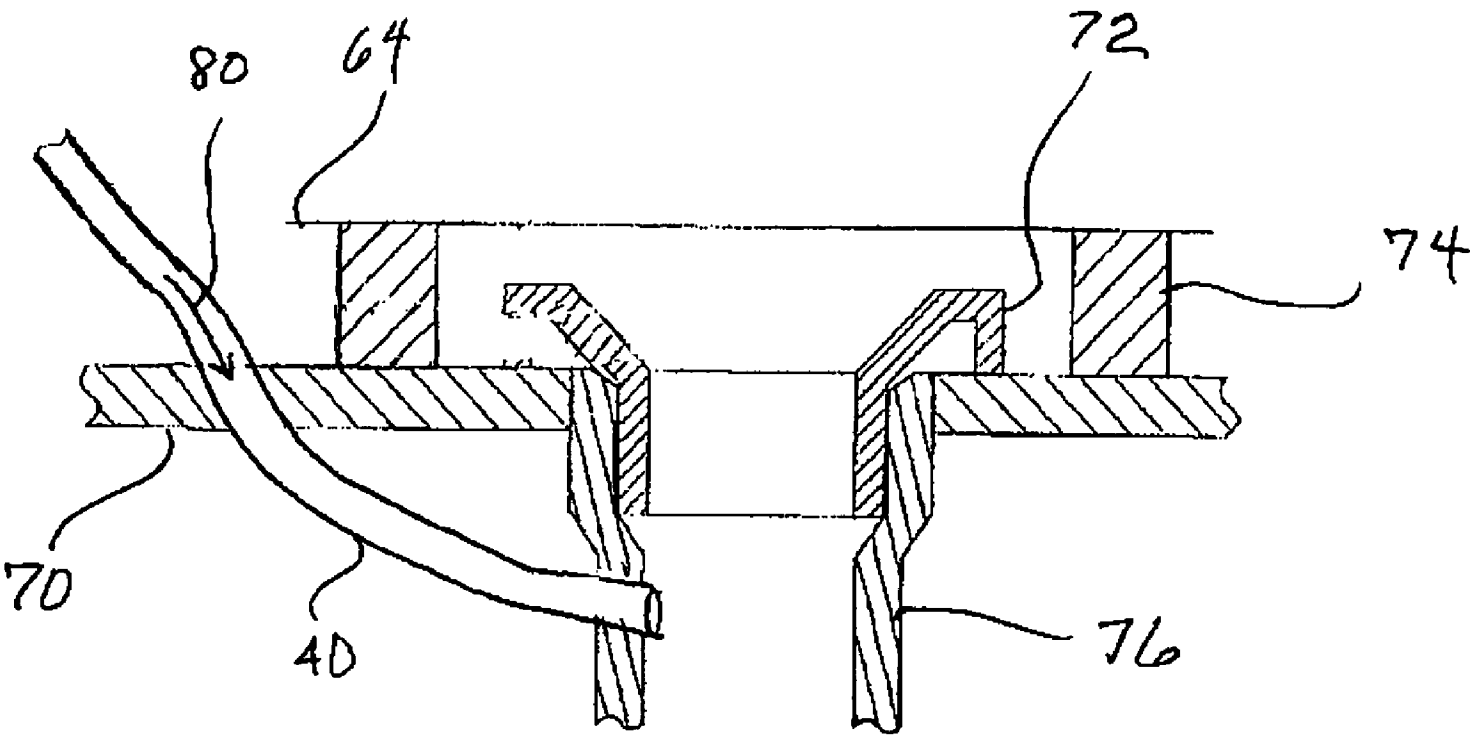
FIG. 4 is a lateral cross sectional view of FIG. 3 along the line 44.

The shape and compactness offered by the integral construction of the conical vacuum pump 32, vacuum motor 30 within pump 32, the check valve 36, and the exhaust 38 provide for fit into the toilet bowl cavity 66. Typical cavities 66 are limited in space and shape. The sewer hose 40 is thereby within the toilet bowl cavity 66 prior to exiting through the floor 70 (FIGS. 3 and 4). The vacuum hose 28 is therefore the only exposed hose of the invention. The vacuum hose 28 enters bowl cavity 66 via a groove in the bottom of the toilet bowl 64 (not shown). Power cord 44 exits proximal to the seat swivel mount 68 area of seat 12 and vacuum hose 28. Power cord 44 terminates outwardly from the invention in plug/transformer 46 that plugs into a typical electrical outlet (not shown).

Referring to FIGS. 3 and 4, floor 70 houses typical toilet flange 72. Spacer/seal 74 surrounds flange 72. Flange 72 opens downwardly into typical sewer pipe 76. Sewer hose 40 of invention 10 enters the floor 70 proximal to the spacer/seal 74. Sewer hose 40 is within the bowl cavity 66 (FIG. 2) and does not show from the exterior of toilet bowl 64. Sewer hose 40 discharges into sewer pipe 76 in the directional flow 80.

Figures 5, 6:
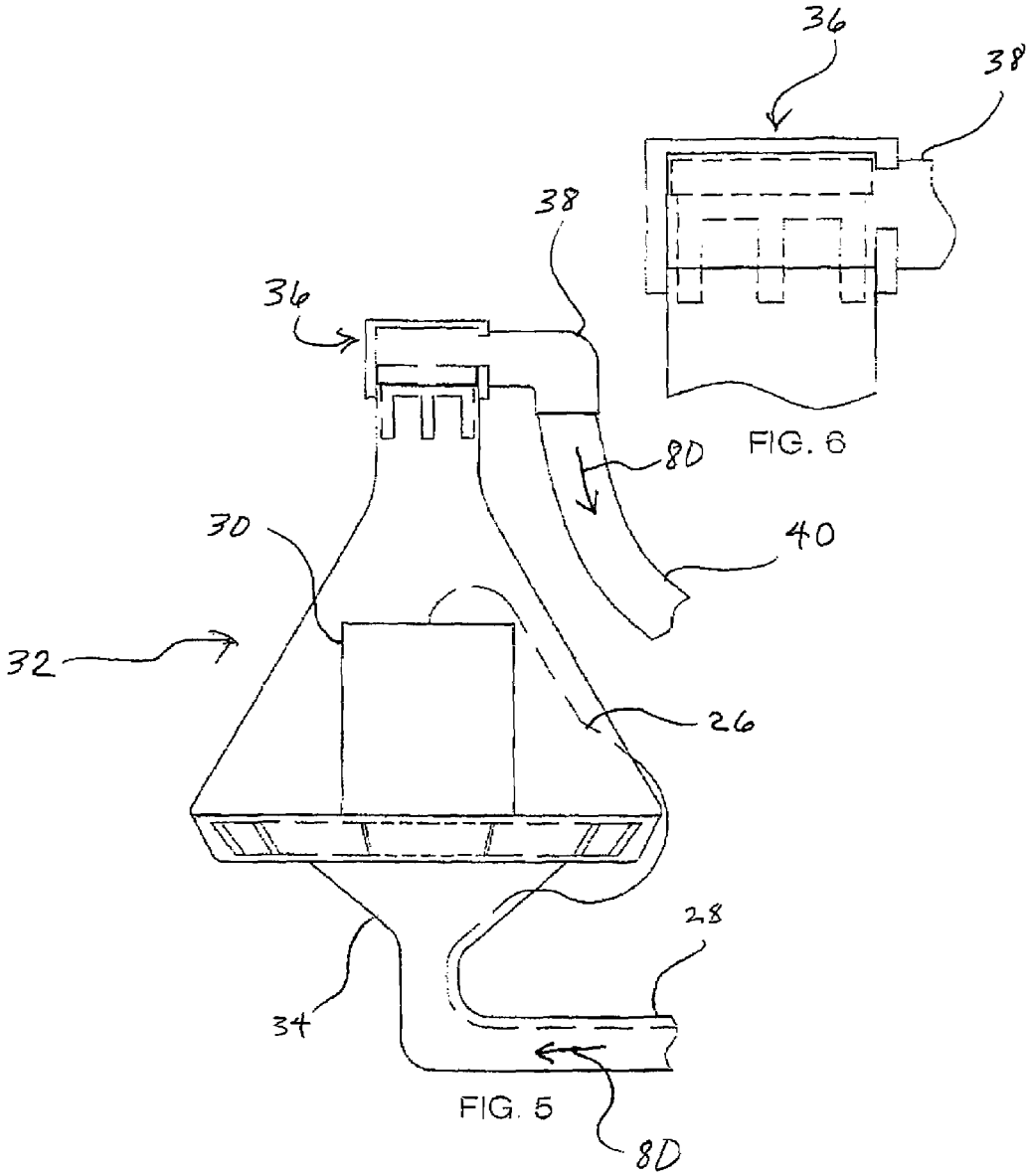
FIG. 5 is a side elevation view of the conical vacuum pump and check valve of the invention.
FIG. 6 is side elevation view of the check valve of the pump.

Referring to FIGS. 5 and 6, conical vacuum pump 32 receives directional flow 80 of gasses into pump intake 34. Vacuum pump 32 also receives switch wire 26 transported via vacuum hose 28. Switch wire 26 supplies vacuum motor 30 for switched power cord 44 from plug transformer 46. Directional flow 80 exits conical vacuum pump 32 via check valve 36 affixed atop conical vacuum pump 32. The check valve 36 is made integrally into the top of the vacuum pump 32. Integral construction of the vacuum pump 32, the vacuum motor 30, and the check valve 36 provide for a compact assembly. Exhaust 38 provides for a downward right angled exit of gasses into sewer hose 40 of invention 10. The right angled downward exit of exhaust 38 provides placement of the sewer hose 40 proximal to the conical vacuum pump 32.

The invention is installed either prior to a toilet 60 installation or after temporarily removing an installed toilet 60. The seat 12 is installed via seat swivel mounts 68. The conical vacuum pump 32 is installed in the bowl cavity 66 of the toilet bowl 64. A hole is made into the floor beneath the toilet bowl 64 base, proximal to the toilet flange 72. A hole is made in the side wall of the typical sewer pipe 76. Sewer hose 40 exits bowl cavity 66 and is inserted into floor 70, then into sewer pipe 76. The toilet is installed onto the spacer seal 74. Power wire 44 with plug/transformer 46 is plugged into a standard electrical outlet. Seat 12 is mounted onto toilet bowl top 65 via seat swivel mount 68. When seat 12 is sat upon by a user (not shown), the weight of the user trips on/off switch 24 to on. On/off switch 24 energizes vacuum motor 30 and therefore conical vacuum pump 32. Gasses are drawn into seat 12 and conducted to outlet into sewer pipe 76. Removal of the weight of a user triggers off of on/off switch 24.

With respect to the above description then, it is to be realized that the optimum dimensional relationships for the parts of the toilet ventilation system, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A toilet ventilation system for use with a typical toilet, the system comprising:

a seat comprised of an oval shape matching the toilet;

a pair of seat swivel mounts at a rear of the seat, the swivel mounts attaching to a toilet bowl top;

a plurality of vacuum intake holes disposed on a lower side of the seat;

a vacuum canal enclosed within the seat, the vacuum canal communicating with the vacuum intake holes, the vacuum canal terminating in a flexible vacuum outlet proximal to one swivel mount;

a vacuum hose connected to the flexible vacuum outlet;

a conical vacuum pump, the pump connected to the vacuum hose;

an electric vacuum motor integrally connected within the vacuum pump;

a check valve integrally disposed within a top of the conical vacuum pump, whereby exhausted gasses are prevented from returning through the check valve;

an exhaust connected to the check valve, such that the conical vacuum pump, integral vacuum motor, integral check valve, and exhaust are fitted within a bowl cavity of the toilet;

a sewer hose connected to the exhaust, the sewer hose exiting the bowl cavity and connecting to a sewer pipe below the toilet, such that the sewer hose is concealed within the bowl cavity, a floor, and the sewer pipe below the toilet.

2. The invention in claim 1 wherein the system is further comprised of an on/off switch, the switch controlling the vacuum motor.

3. The invention in claim 2 wherein the on/off switch is disposed on a lower surface of the seat, the switch interacting with the toilet bowl top, whereby the electric vacuum motor is energized when the seat is sat upon.

4. The invention in claim 3 wherein the electric vacuum motor is powered by standard electrical outlet power.

5. The invention in claim 3 wherein the vacuum motor is powered by 12 volts, the 12 volts provided by a plug/transformer plugging into standard electrical outlet power.

6. The invention in claim 4 wherein the toilet seat is further comprised of a plurality of outer ventilation holes and inner ventilation holes, the outer ventilation holes and inner ventilation holes communicating with connection tubes within the seat, the connection tubes tangential to the oval shape of the seat and disposed horizontally within the seat.

7. The invention in claim 5 wherein the toilet seat is further comprised of a plurality of outer ventilation holes and inner ventilation holes, the outer ventilation holes and inner ventilation holes communicating with connection tubes within the seat, the connection tubes tangential to the oval shape of the seat and disposed horizontally within the seat.

8. The invention in claim 6 wherein the outer ventilation holes and the inner ventilation holes are disposed within a front portion of the seat.

9. The invention in claim 7 wherein the outer ventilation holes and the inner ventilation holes are disposed within a front portion of the seat.

10. The invention in claim 8 wherein the vacuum intake holes are disposed within a rear half of the seat.

11. The invention in claim 9 wherein the vacuum intake holes are disposed within a rear half of the seat.

12. A toilet ventilation system for use with a typical toilet, the system comprising:

a seat comprised of an oval shape matching the toilet;

a pair of seat swivel mounts at a rear of the seat, the swivel mounts attaching to a toilet bowl top;

a plurality of vacuum intake holes disposed on a lower side of the seat;

a vacuum canal enclosed within the seat, the vacuum canal communicating with the vacuum intake holes, the vacuum canal terminating in a flexible vacuum outlet proximal to one swivel mount;

a vacuum hose connected to the flexible vacuum outlet;

a conical vacuum pump, the pump connected to the vacuum hose;

an electric vacuum motor integrally connected within the vacuum pump;

a check valve integrally disposed within a top of the conical vacuum pump, whereby exhausted gasses are prevented from returning through the check valve;

an exhaust connected to the check valve, the exhaust comprising a right angle downward exit, the exit proximal to the check valve, such that the conical vacuum pump, integral vacuum motor, integral check valve, and exhaust are fitted within a bowl cavity of the toilet;

a sewer hose connected to the exhaust, the sewer hose exiting the bowl cavity and connecting to a sewer pipe below the toilet, such that the sewer hose is concealed within the bowl cavity, a floor, and the sewer pipe below the toilet.

13. The invention in claim 12 wherein the system is further comprised of an on/off switch, the switch controlling the vacuum motor.

14. The invention in claim 13 wherein the on/off switch is disposed on a lower surface of the seat, the switch interacting with the toilet bowl top, whereby the electric vacuum motor is energized when the seat is sat upon.

15. The invention in claim 14 wherein a front portion of the toilet seat is further comprised of a plurality of outer ventilation holes and inner ventilation holes, the outer ventilation holes and inner ventilation holes communicating with connection tubes within the seat, the connection tubes tangential to the oval shape of the seat and disposed horizontally within the seat.

16. The invention in claim 15 wherein the vacuum motor is powered by 12 volts, the 12 volts provided by a plug/transformer plugging into standard electrical outlet power.

17. The invention in claim 16 wherein the vacuum intake holes are disposed within a rear half of the seat, the vacuum intake holes opening downwardly toward the toilet bowl.

18. A toilet ventilation system for use with a typical toilet, the system comprising:

a seat comprised of an oval shape matching the toilet;

a pair of seat swivel mounts at a rear of the seat, the swivel mounts attaching to a toilet bowl top;

a plurality of vacuum intake holes disposed on a rear half of a lower side of the seat;

a vacuum canal enclosed within the seat, the vacuum canal communicating with the vacuum intake holes, the vacuum canal terminating in a flexible vacuum outlet proximal to one swivel mount;

a plurality of outer ventilation holes and inner ventilation holes, the outer ventilation holes and inner ventilation holes communicating with connection tubes within the eat, the connection tubes tangential to the oval shape of the seat and disposed horizontally within a front half of the seat, a vacuum hose connected to the flexible vacuum outlet;

a conical vacuum pump, the pump connected to the vacuum hose;

an electric vacuum motor integrally connected within the vacuum pump;

a plug/transformer plugging into standard electrical outlet power;

a power cord connecting the plug/transformer to the vacuum motor, the power cord partially housed within the vacuum hose, the power cord entering the vacuum hose proximal to the flexible vacuum outlet;

an on/off switch controlling the vacuum motor, the on/off switch disposed on a lower surface of the seat, the switch interacting with the toilet bowl top;

a switch wire connecting the on/off switch to the vacuum motor, the switch wire disposed within the vacuum canal and the vacuum hose, such that the electric vacuum motor is energized when the seat is sat upon;

a check valve integrally disposed within a top of the conical vacuum pump, whereby exhausted gasses are prevented from returning through the check valve;

an exhaust connected to the check valve, the exhaust comprising a right angle downward exit, the exit proximal to the check valve, such that the conical vacuum pump, integral vacuum motor, integral check valve, and exhaust are fitted within a bowl cavity of the toilet;

a sewer hose connected to the exhaust, the sewer hose exiting the bowl cavity and connecting to a sewer pipe below the toilet, such that the sewer hose is concealed within the bowl cavity, a floor, and the sewer pipe below the toilet.

* * * * *